US008212460B1

(12) United States Patent
Hsieh

(10) Patent No.: US 8,212,460 B1
(45) Date of Patent: Jul. 3, 2012

(54) LED LAMP

(75) Inventor: Duan-Cheng Hsieh, Taipei (TW)

(73) Assignee: Habitex Corporation, Taipei (TW)

( * ) Notice: Subject to any disclaimer, the term of this patent is extended or adjusted under 35 U.S.C. 154(b) by 0 days.

(21) Appl. No.: 13/095,271

(22) Filed: Apr. 27, 2011

(51) Int. Cl.
*H01J 1/02* (2006.01)
*F21V 29/00* (2006.01)

(52) U.S. Cl. ..... 313/46; 362/84; 362/294

(58) Field of Classification Search ..... 313/46, 313/512, 318.01; 362/84, 293, 311.06, 294; 438/27; 439/669
See application file for complete search history.

(56) References Cited

U.S. PATENT DOCUMENTS 6,864,513 B2 * 3/2005 Lin et al. ..... 257/99
2012/0033429 A1 * 2/2012 Van De Ven ..... 362/294
2012/0057327 A1 * 3/2012 Le et al. ..... 362/84
* cited by examiner

*Primary Examiner* — Joseph L Williams
(74) *Attorney, Agent, or Firm* — John A. Fortkort; Fortkort & Houston P.C.

(57) ABSTRACT

A LED lamp includes: a first base body including a first mating portion; alight emitting unit including a printed circuit board and a LED chip; a second base body including a second mating portion; a plug disposed in the first base body, and including an insulating tube, a first electrical contact formed on an inner surface of the insulating tube, and a second electrical contact formed on an outer surface of the insulating tube; a socket formed in the second base body and including a third electrical contact to electrically contact the first electrical contact, and a fourth electrical contact to electrically contact the second electrical contact; a first wire electrically connecting a positive electrode of the LED chip to the first electrical contact; and a second wire electrically connecting a negative electrode of the LED chip to the second electrical contact.

10 Claims, 5 Drawing Sheets

LED LAMP

BACKGROUND OF THE INVENTION

1. Field of the Invention

This invention relates to a LED lamp, more particularly to a LED lamp having an improved electrical connection.

2. Description of the Related Art

Conventionally, a LED lamp is electrically connected to a power supply by respectively soldering two wires from positive and negative electrodes of a LED chip to respective conductors of a predetermined circuit path, or by twisting each of the two wires with one of the conductors, followed by wrapping the twisted wire and conductor with an insulating tape.

However, when replacing or repairing the conventional LED lamp, a short circuit is likely to be formed when removing the wires from electrical contacts of a lamp seat.

SUMMARY OF THE INVENTION

Therefore, an object of the present invention is to provide a LED lamp that can overcome the aforesaid drawbacks associated with the prior art.

Accordingly, a LED lamp of this invention comprises:

a first base body including upper and lower sides and a first mating portion disposed at the lower side;

a light emitting unit including a printed circuit board mounted to the upper side of the first base body, and a LED chip disposed on the printed circuit board;

a second base body including a second mating portion connectable to the first mating portion;

a plug disposed in the first base body, and including an insulating tube protruding out of the first mating portion, a first electrical contact formed on an inner surface of the insulating tube, and a second electrical contact formed on an outer surface of the insulating tube;

a socket formed in the second base body to receive the plug, and including a third electrical contact to electrically contact the first electrical contact, and a fourth electrical contact disposed around the third electrical contact to electrically contact the second electrical contact;

a first wire electrically connecting a positive electrode of the LED chip to the first electrical contact; and a second wire electrically connecting a negative electrode of the LED chip to the second electrical contact.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
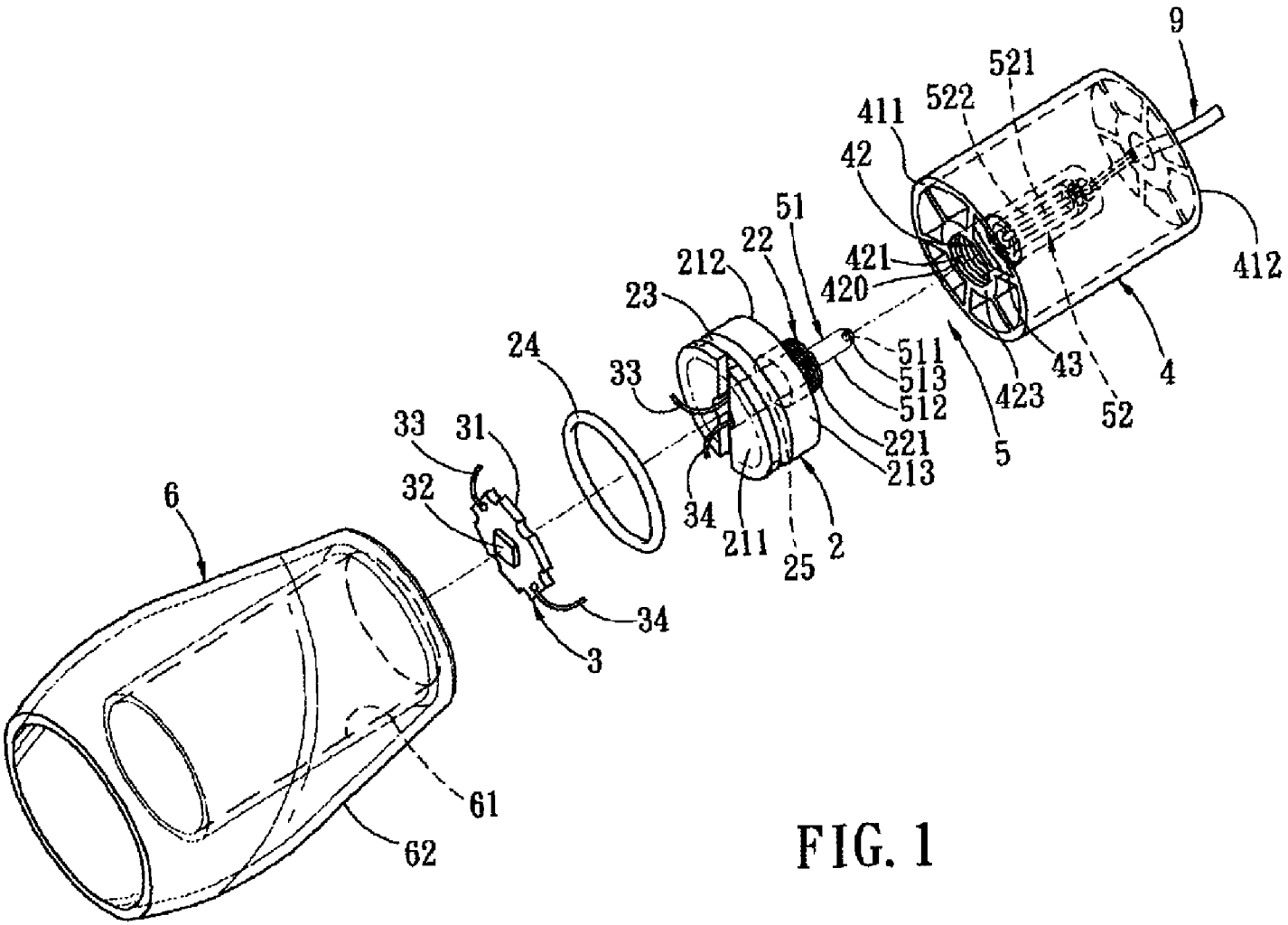
FIG. 1 is an exploded perspective view of the first preferred embodiment of a LED lamp according to the present invention.

Before the present invention is described in greater detail with reference to the accompanying preferred embodiments, it should be noted herein that like elements are denoted by the same reference numerals throughout the disclosure.

Figure 2:
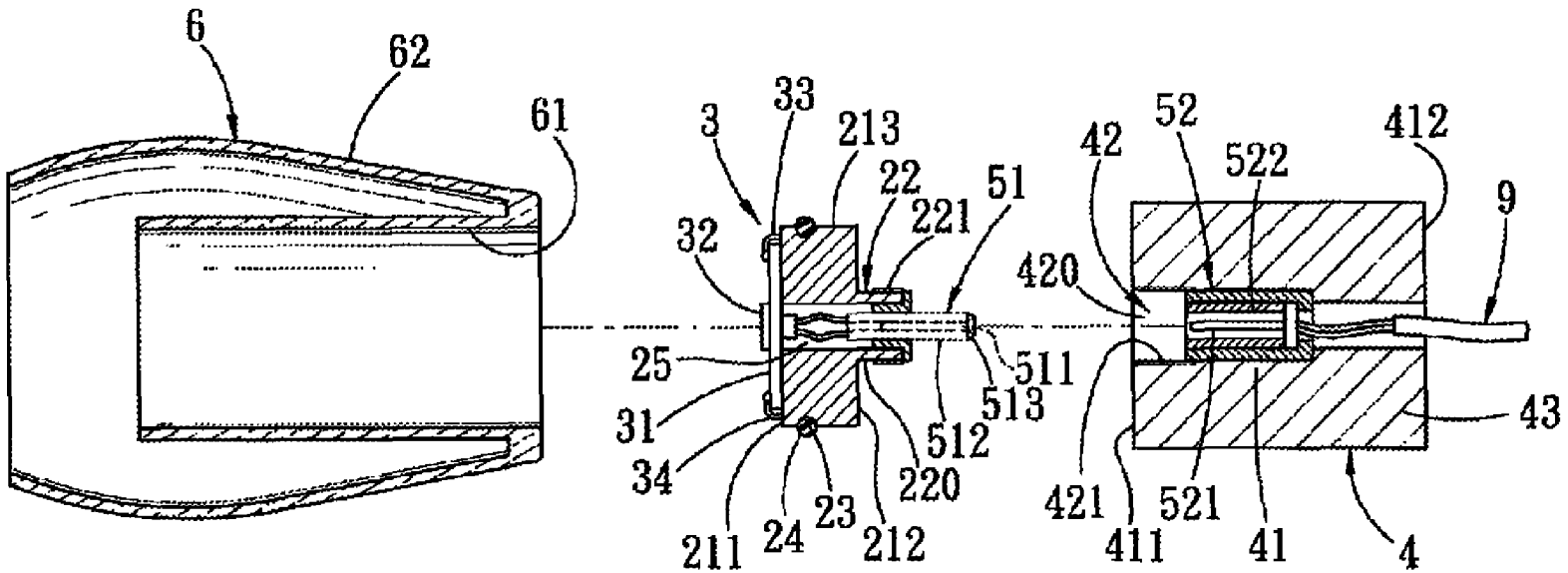
FIG. 2 is an exploded cross-sectional view of the first preferred embodiment of the LED lamp shown in FIG. 1.
Figure 3:
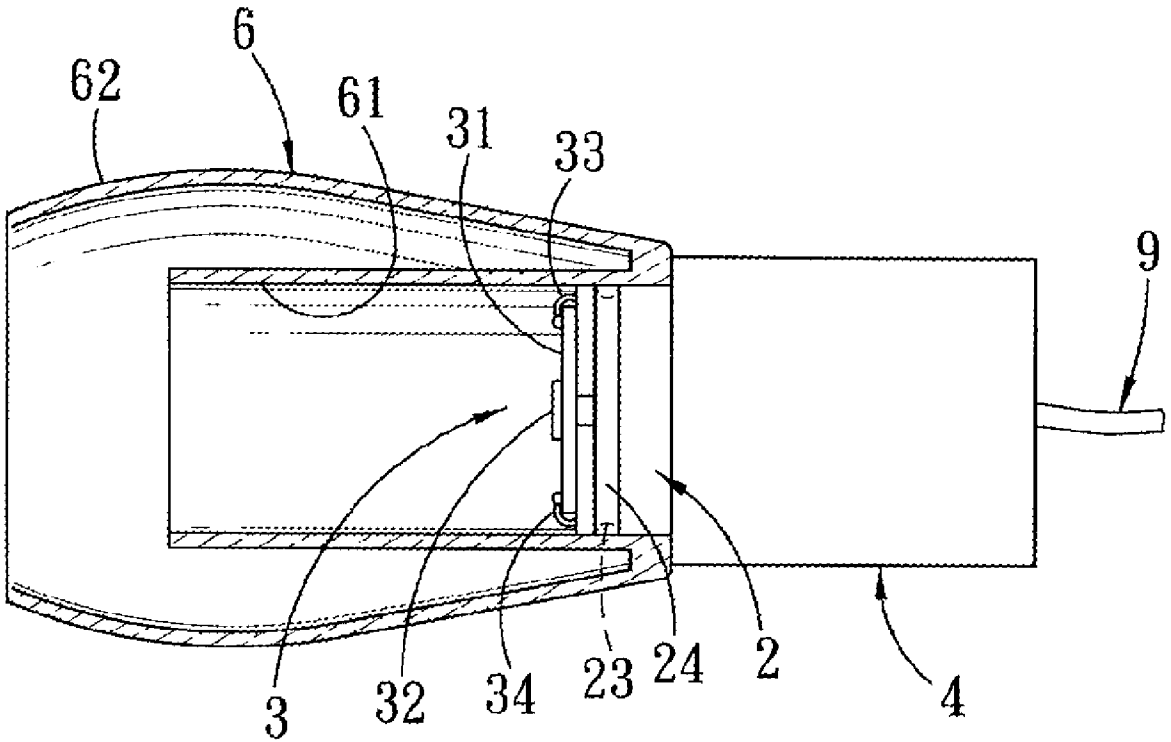
FIG. 3 is a partially sectioned view of the first preferred embodiment of the LED lamp of FIG. 1 in an assembled state.

Referring to FIGS. 1 to 3, the first preferred embodiment of a LED lamp according to the present invention comprises a first base body 2, alight emitting unit 3, a second base body 4, an electrical connection unit 5, and a transparent lamp housing 6.

The first base body 2 includes upper and lower sides 211, 212, a ffirst mating portion 22 disposed at the lower side 212, an annular recess 23, and a resilient ring 24. The annular recess 23 is indented from an annular outer surface 213 of the first base body 2 between the upper and lower sides 211, 212. The resilient ring 24 is fitted in the annular recess 23 and protrudes from the annular outer surface 213 of the first base body 2.

The first mating portion 22 has a protrusion 220 protruding at the lower side 212 of the first base body 2, and a male thread 221 formed around the protrusion 220. The first base body 2 further has a through hole 25 formed in the first base body 2 and extending through the upper side 211 and the protrusion 220.

The light emitting unit 3 includes a printed circuit board 31 mounted to the upper side 211 of the first base body 2, and a LED chip 32 disposed on the printed circuit board 31.

The second base body 4 includes a housing wall 41, top and bottom ends 411, 412, a second mating portion 42 disposed inside the housing wall 41 and connectable to the first mating portion 22, and a plurality of heat sink fins 43. The second mating portion 42 has a tubular wall 423 defining a mating hole 420 (see FIG. 1) that extends downwardly from the top end 411 to receive the first mating portion 22. The heat sink fins 43 extend radially from the tubular wall 423 to the housing wall 41. In this preferred embodiment, the mating hole 420 has a female thread 421 to engage the male thread 221.

The electrical connection unit 5 includes a plug 51, a socket 52, and first and second wires 33, 34.

The plug 51 is tubular, and is disposed in the first base body 2 and electrically connected to the printed circuit board 31. The plug 51 includes an insulating tube 513 protruding out of the first mating portion 22, a first electrical contact 511 formed on an inner surface of the insulating tube 513, and a second electrical contact 512 formed on an outer surface of the insulating tube 513. The plug 51 is fixed within the through hole 25 and extends out of the protrusion 220 for insertion into the socket 52.

The socket 52 is formed in the tubular wall 423 of the second mating portion 42 below the mating hole 420 to receive the plug 51, and includes a third electrical contact 521 to electrically contact the first electrical contact 511, and a fourth electrical contact 522 disposed around the third electrical contact 521 to electrically contact the second electrical contact 512. Preferably, the third electrical contact 521 is formed as a pin in the socket 52, and the fourth electrical contact 522 is formed as a tubular shell surrounding the pin in the socket 52. The socket 52 receives the plug 51 when the first mating portion 22 is inserted into the mating hole 420. The socket 52 is further electrically connected to an external power source 9.

The first wire 33 electrically connects a positive electrode of the LED chip 32 to the first electrical contact 511 via the printed circuit board 31. The second wire 34 electrically connects a negative electrode of the LED chip 32 to the second electrical contact 512 via the printed circuit board 31. The first and second wires 33, 34 are received in the through hole 25 of the first base body 2 and are also respectively electrically connected to the first and second electrical contacts 511, 512.

The lamp housing 6 is disposed around the first base body 2 and engages the resilient ring 24. The lamp housing 6 has an inner wall surface 61 surrounding the first base body 2 and engaging the resilient ring 24, and an outer wall surface 62 surrounding the inner wall surface 61.

In this embodiment, while the first mating portion 22 has the protrusion 220 formed with the male thread 221 and the second mating portion 42 is configured as the mating hole 420 having the female thread 421 to engage the male thread 221 of the first mating portion 22, the structures of the first and second mating portions 22, 42 should not be limited to this embodiment. In other embodiment, the first mating portion can be configured as a mating hole having a female thread (not shown), and the second mating portion can have a protrusion with a male thread (not shown) to engage the female thread of the first mating portion.

Because the light emitting unit 3 is integrated with the first base body 2 and the plug 51 as a unitary structure, which can be removed easily from the second base body 4, the light emitting unit 3 can be replaced easily when the LED chip 32 fails. Replacement of the LED chip 32 can be conducted without using any tool and by simply removing the lamp housing 6 from the first base body 2, removing the first base body 2 from the second base body 4, and by reassembling a new unitary structure of the light emitting unit 3, the first base body 2 and the plug 51 to the second base body 4 and the lamp housing 6. Furthermore, because the wires 33 and 34 are disposed within the first base body 2, they are not easily separable from the light emitting unit 3. Accordingly, a short circuit due to disconnections between the wires 33 or 34 and the LED chip 32 or between the wires 33 or 34 and the plug 51 during the replacement of the LED chip 32 can be eliminated in this invention.

Figure 4:
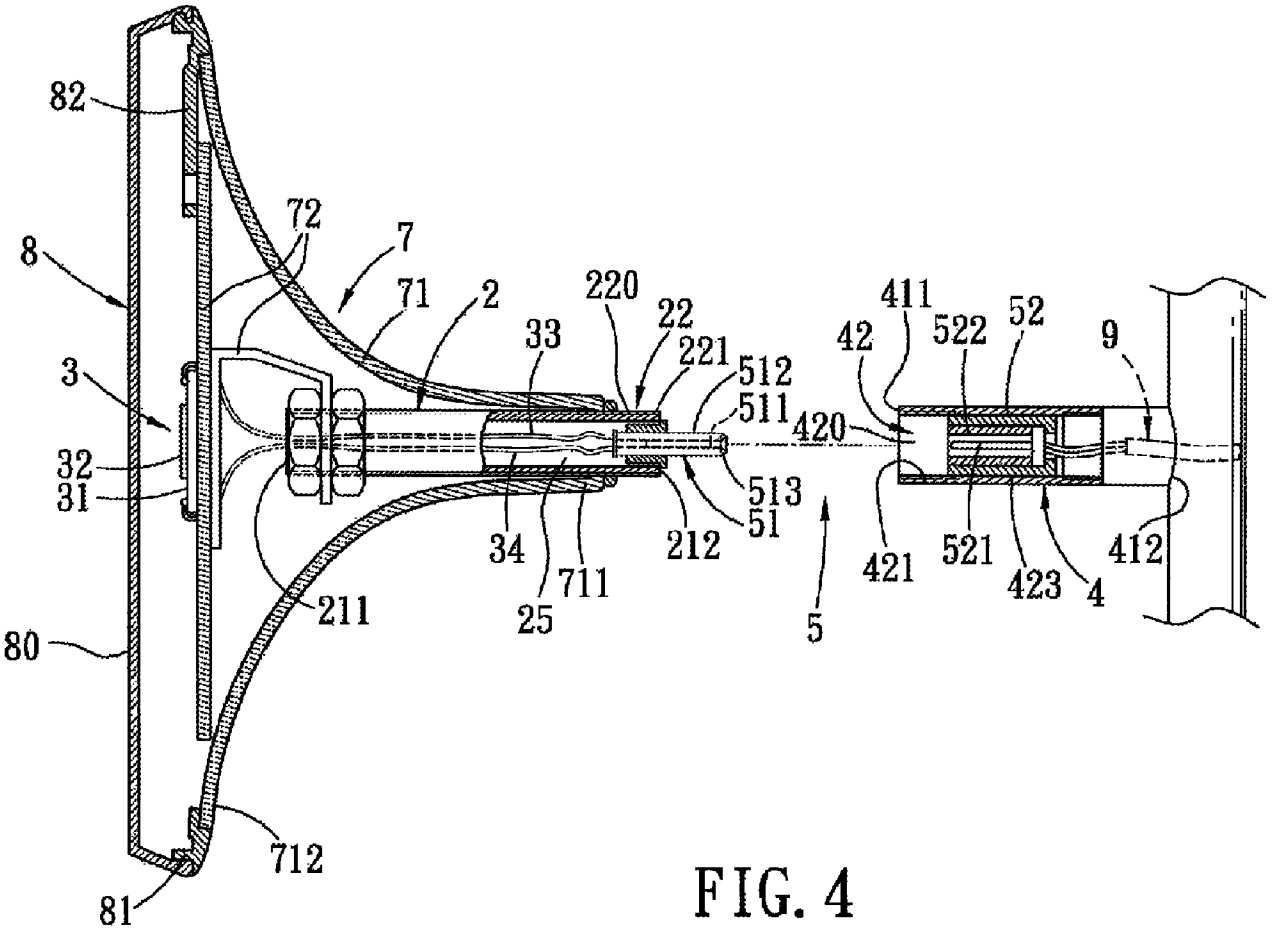
FIG. 4 is a cross-sectional view of the second preferred embodiment of a LED lamp according to the present invention.
Figure 5:
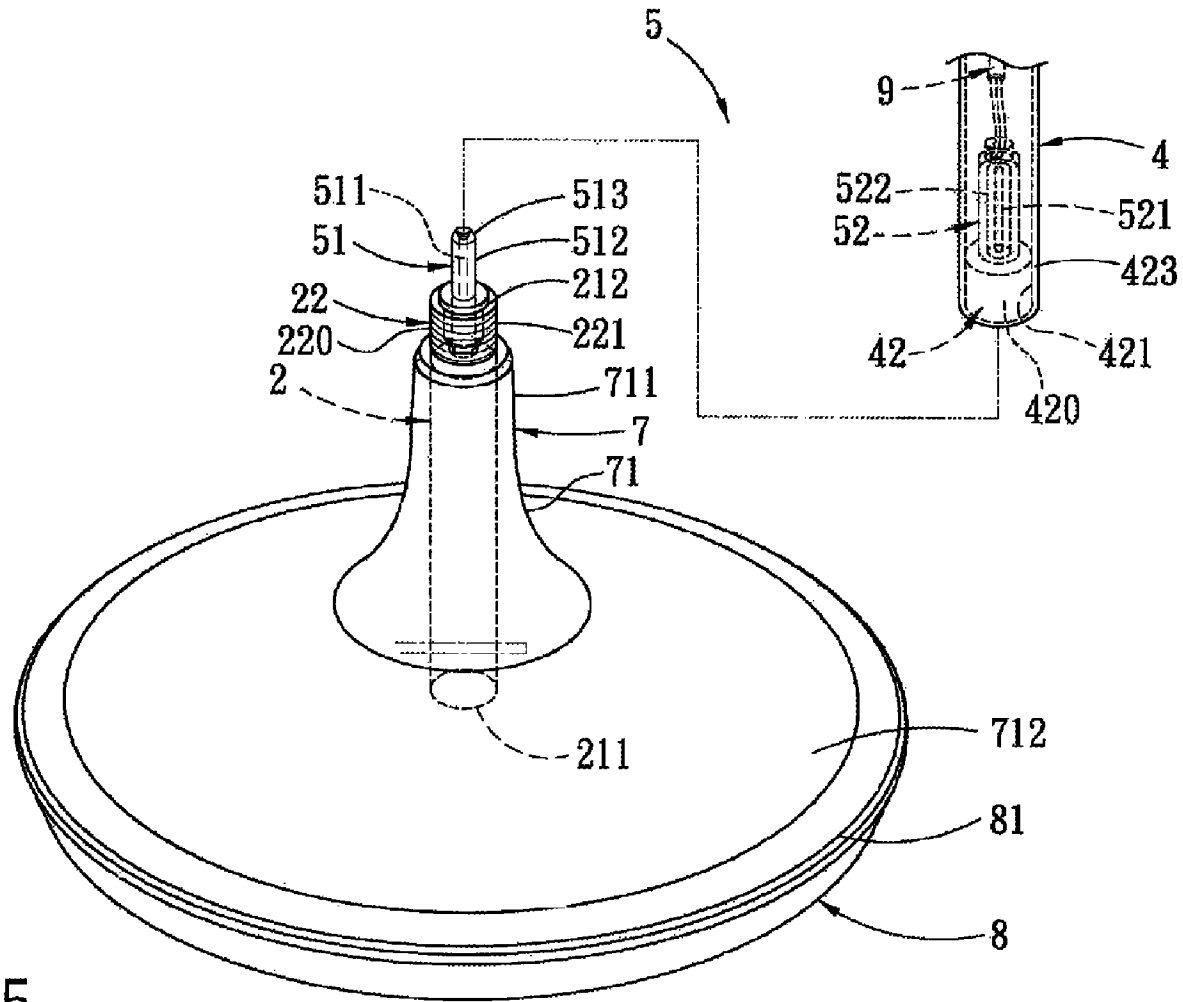
FIG. 5 is a perspective view of the second preferred embodiment of the LED lamp of FIG. 4.

FIGS. 4 and 5 illustrate the second preferred embodiment of a LED lamp of this invention. The second preferred embodiment differs from the first preferred embodiment in the structure of the second base body 4. Furthermore, the second preferred embodiment of the LED lamp does not include the lamp housing 6, but further includes a heat sink cover 7, a support frame 72, and a light-transmissive cover 8. The heat sink cover 7 may serve as a heat sink for the light emitting unit 3.

In the second preferred embodiment, the second base body 4 includes the tubular wall 423, the top and bottom ends 411, 912, and the second mating portion 42 connectable to the first mating portion 22. The second mating portion 42 has a mating hole 420 that is defined by the tubular wall 923 and that extends downwardly from the top end 911 to receive the first mating portion 22.

The heat sink cover 7 is disposed around the first base body 2, and includes a tubular portion 711 sleeved around the first base body 2, and a flared portion 712 flared outwardly from the tubular portion 711. The first mating portion 22 extends outwardly from the tubular portion 711. The flared portion 712 is opposite to the first mating portion 22.

The support frame 72 is connected to the upper side 211 of the first base body 2 within the flared portion 712. The light emitting unit 3 is mounted to the support frame 72.

The light-transmissive cover includes a cover body 80 fixed to an open end of the flared portion 712 to cover the light emitting unit 3, and a fixing ring 81 to fix the cover body 80 to the open end of the flared portion 712. The fixing ring 81 has a plurality of arms 82 (only one is shown in FIG. 4) that extend inward from the fixing ring 81 at angularly spaced apart positions and that are secured to the support frame 72.

Like the first embodiment, replacement of the light emitting unit 3 is also convenient in the second embodiment. The heat sink cover 7 in the second preferred embodiment may be removed readily from the first base body 2 by detaching the arms 82 from the support frame 72.

While the present invention has been described in connection with what are considered the most practical and preferred embodiments, it is understood that this invention is not limited to the disclosed embodiments but is intended to cover various arrangements included within the spirit and scope of the broadest interpretations and equivalent arrangements.

What is claimed is:

1. A LED lamp, comprising:

a first base body including upper and lower sides and a first mating portion disposed at said lower side;

a light emitting unit including a printed circuit board mounted to said upper side of said first base body, and a LED chip disposed on said printed circuit board;

a second base body including a second mating portion connectable to said first mating portion;

a plug disposed in said first base body, and including an insulating tube protruding out of said first mating portion, a first electrical contact formed on an inner surface of said insulating tube, and a second electrical contact formed on an outer surface of said insulating tube;

a socket formed in said second base body to receive said plug, and including a third electrical contact to electrically contact said first electrical contact, and a fourth electrical contact disposed around said third electrical contact to electrically contact said second electrical contact;

a first wire electrically connecting a positive electrode of said LED chip to said first electrical contact; and a second wire electrically connecting a negative electrode of said LED chip to said second electrical contact.

2. The LED lamp of claim 1, wherein said second mating portion has top and bottom ends, a tubular wall extending from said top end toward said bottom end, and a mating hole defined by said tubular wall and extending downwardly from said top end to receive said first mating portion, said socket being formed in said tubular wall below said mating hole, said socket receiving said plug when said first mating portion is inserted into said mating hole.

3. The LED lamp of claim 2, wherein said first mating portion has a protrusion protruding at said lower side of said first base body, and a male thread formed around said protrusion, said mating hole having a female thread to engage said male thread.

4. The LED lamp of claim 2, wherein said third electrical contact is formed as a pin in said socket, and said fourth electrical contact is formed as a tubular shell surrounding said pin in said socket.

5. The LED lamp of claim 3, wherein said first base body further has a through hole formed in said first base body and extending through said upper side and said protrusion, said first and second wires being received in said through hole and connected respectively to said positive and negative electrodes, said plug being fixed within said through hole and extending out of said protrusion for insertion into said socket.

6. The LED lamp of claim 1, further comprising a lamp housing, said first base body further including an annular recess indented from an annular outer surface of said first base body between said upper and lower sides, and a resilient ring fitted in said annular recess and protruding from said annular outer surface of said first base body, said lamp housing being disposed around said first base body and engaging said resilient ring.

7. The LED lamp of claim 6, wherein said lamp housing has an inner wall surface surrounding said first base body and engaging said resilient ring, and an outer wall surface surrounding said inner wall surface.

8. The LED lamp of claim 5, further comprising:

a heat sink cover disposed around said first base body, and including a tubular portion sleeved around said first base body, and a flared portion flared outwardly from said tubular portion, said first mating portion extending outwardly from said tubular portion, said flared portion being opposite to said first mating portion; and a support frame connected to said upper side of said first base body within said flared portion, said light emitting unit being mounted to said support frame.

9. The LED lamp of claim 8, further comprising a light-transmissive cover that includes a cover body fixed to an open end of said flared portion to cover said light emitting unit.

10. The LED lamp of claim 9, wherein said light-transmissive cover further includes a fixing ring to fix said cover body to said open end of said flared portion, said fixing ring having a plurality of arms that extend inward from said fixing ring at angularly spaced apart positions and that are secured to said support frame.

* * * * *